US009171552B1

(12) United States Patent
Yang

(10) Patent No.: US 9,171,552 B1
(45) Date of Patent: Oct. 27, 2015

(54) MULTIPLE RANGE DYNAMIC LEVEL CONTROL

(71) Applicant: Rawles LLC, Wilmington, DE (US)

(72) Inventor: Jun Yang, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 190 days.

(21) Appl. No.: 13/744,134

(22) Filed: Jan. 17, 2013

(51) Int. Cl.
*G10L 21/00* (2013.01)
*G10L 19/00* (2013.01)
*G10L 21/0308* (2013.01)

(52) U.S. Cl.
CPC ..... *G10L 21/0308* (2013.01)

(58) Field of Classification Search
USPC ..... 704/200, 200.1, 201, 225; 348/462, 348/736, 738; 381/104, 107
See application file for complete search history.

(56) References Cited

U.S. PATENT DOCUMENTS

| | | | | |
|---|---|---|---|---|
| 6,311,155 | B1 * | 10/2001 | Vaudrey et al. | 704/225 |
| 6,812,771 | B1 | 11/2004 | Behel et al. | |
| 6,816,013 | B2 | 11/2004 | Kao | |
| 7,398,207 | B2 * | 7/2008 | Riedl | 704/225 |
| 7,418,392 | B1 | 8/2008 | Mozer et al. | |
| 7,617,109 | B2 * | 11/2009 | Smithers et al. | 704/500 |
| 7,720,683 | B1 | 5/2010 | Vermeulen et al. | |
| 7,774,204 | B2 | 8/2010 | Mozer et al. | |
| 8,355,909 | B2 * | 1/2013 | Carroll et al. | 704/225 |
| 2004/0044525 | A1 * | 3/2004 | Vinton et al. | 704/224 |
| 2009/0074209 | A1 * | 3/2009 | Thompson et al. | 381/107 |
| 2012/0223885 | A1 | 9/2012 | Perez | |

FOREIGN PATENT DOCUMENTS

WO WO2011088053 A2 7/2011

OTHER PUBLICATIONS

Chen et al., "Adaptive Postfiltering for Quality Enhancement of Coded Speech", IEEE Transactions on Speech and Audio Processing, vol. 3, No. 1, Jan. 1995, pp. 59-71.
Glisson, et al., "The Digital Computation of Discrete Spectra Using the Fast Fourier Transform", IEEE Transactions on Audio and Electroacoustics, vol. AU—18, No. 3, Sep. 1970, pp. 271-287.
Pinhanez, "The Everywhere Displays Projector: A Device to Create Ubiquitous Graphical Interfaces", IBM Thomas Watson Research Center, Ubicomp 2001, Sep. 30-Oct. 2, 2001, 18 pages.

* cited by examiner

*Primary Examiner* — Jesse Pullias
(74) *Attorney, Agent, or Firm* — Lee & Hayes, PLLC

(57) ABSTRACT

An audio-based system may perform dynamic level adjustment by detecting voice activity in an input signal and evaluating voice levels during periods of voice activity. The current voice level is compared to a plurality of thresholds to determine a corresponding gain strategy, and the input signal is scaled in accordance with this gain strategy. Further adjustment to the signal is performed to reduce output clipping that might otherwise be produced.

20 Claims, 3 Drawing Sheets

MULTIPLE RANGE DYNAMIC LEVEL CONTROL

BACKGROUND

Dynamic level control (DLC) is used in many systems to generate an audio signal with a desired loudness or amplitude based on an input signal with varying levels of amplitudes. DLC, also referred to as automatic gain control (AGC), has become important in network-based digital telephony systems, where a restricted gain or loss is introduced in a transmission path to maintain the transmitted signal level at a predetermined value. In this context, DLC is part of a broader class of voice quality enhancement (VQE) devices, which may include network echo cancellation, noise reduction, and other related signal enhancement processing elements.

In applications with small speakers, such as in phones, media players, mobile devices, and other components, DLC is used to boost and enhance the loudness and clarity of an audio signal. DLC may also be used to self-adjust the front-end gain of linear prediction analyzer-based phone codecs in such a way that the voice waveform is more accurately quantized by an analog-to-digital converter.

For radio, television, and home theater applications, DLC allows users to easily adjust the dynamic range of sound to avoid disturbing others, while still allowing users to hear a program without turning up the volume.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Described herein are techniques for dynamic level control (DLC), also referred to as automatic gain control (AGC), which may be used in conjunction with signal processing techniques to produce output signals of desired and/or constant amplitudes. In particular, the described techniques may be used to vary audio amplification gains in audio processing systems in order to achieve relatively constant voice levels, despite input audio levels that vary over time.

In the embodiments described herein, an input audio signal may be captured by one or more audio inputs (e.g., microphones). The input audio signal may contain segments of voice activity, upon which voice level determinations are based. A voice level is compared against multiple thresholds, to determine which of multiple ranges the voice level falls within. The input audio signal is then scaled by a gain that is selected in a manner that depends on the range within which the voice level falls. The gain may be smoothed over time, and the resulting audio signal may then be subjected to further processing to prevent clipping of the output audio signal, which may be output by one or more audio outputs (e.g., speakers).

Note that although the following techniques are described below with application to a stereo signal, the techniques are more generally applicable to single and multiple channel audio systems.

Figure 1:
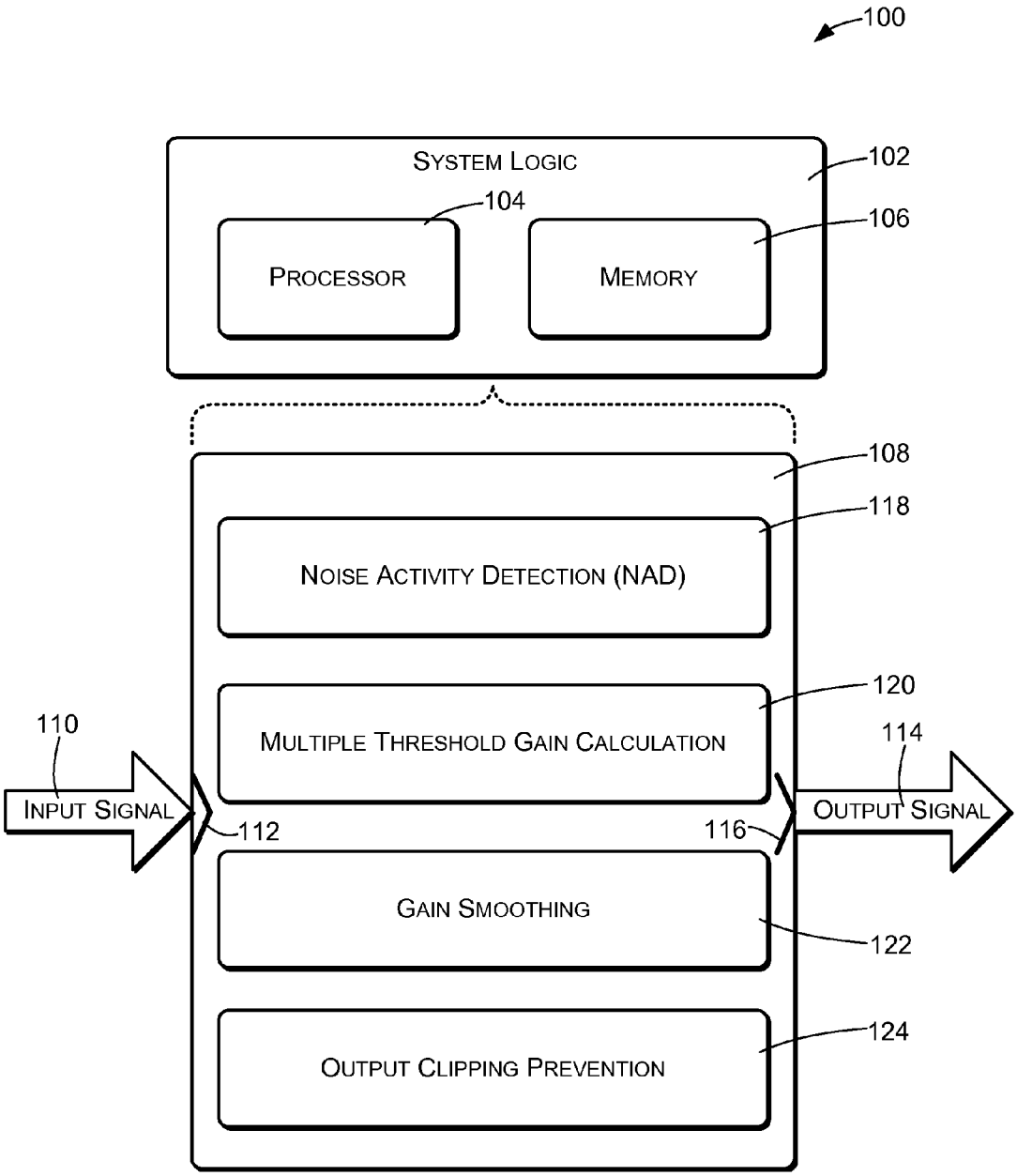
FIG. 1 is a block diagram of a system that is configured to apply multiple-threshold dynamic level control to an audio signal.

FIG. 1 shows an example of an audio system, element, or component 100 that may be used to perform dynamic level control (DLC) with respect to an audio signal. The audio system 100 comprises system logic 102, which in some embodiments may comprise a programmable device or system formed by a processor 104, associated memory 106, and other related components. The processor 104 may be a digital processor, a signal processor, or similar type of device that performs operations based on instructions and/or programs stored in the memory 106. In other embodiments, the functionality attributed herein to the system logic 102 may be performed by other means, including non-programmable elements such as analog components, discrete logic elements, and so forth.

The system logic 102 is configured to implement functional elements 108. Generally, the system 100 receives an input signal 110 at an input port 112 and processes the input signal 110 to produce an output signal 114 at an output port 116. The input signal 110 may comprise a single mono audio channel, a pair of stereo audio channels, or a set of more than two audio channels. Similarly, the output signal 114 may comprise a single mono audio channel, a pair of stereo audio channels, or a set of more than two audio channels. The input and output signals may comprise analog or digital signals, and may represent audio in any of various different formats.

The functional elements 108 implemented by the system logic 102 may include a noise activity detection (NAD) component 118, which can be used to detect voice activity in an audio segment or sample. NAD may be performed using various techniques. For example, the NAD component 118 may calculate a ratio between the envelope of the audio signal and the noise floor of the audio signal, and may use the ratio as an indication of noise and/or voice presence.

The functional elements 108 of the system logic 102 may also include a multiple threshold gain calculation component 120, which dynamically selects a gain or gain strategy to be applied to the input signal 110. The gain is selected so that the perceived level or amplitude of the output signal 114 remains relatively constant over time.

The functional elements 108 of the system logic 102 may further include a gain smoothing component 122, which is configured to smooth or average the gain produced by the gain calculation component 120 over time. For example, the gain smoothing component 122 may comprise a first order low-pass filter that is applied to sequential gain values produced by the gain calculation component 120.

The functional elements 108 of the system logic 102 may further include an output clipping prevention component 124 that attenuates peaks of the output signal 114 as necessary to prevent clipping.

Figure 2:
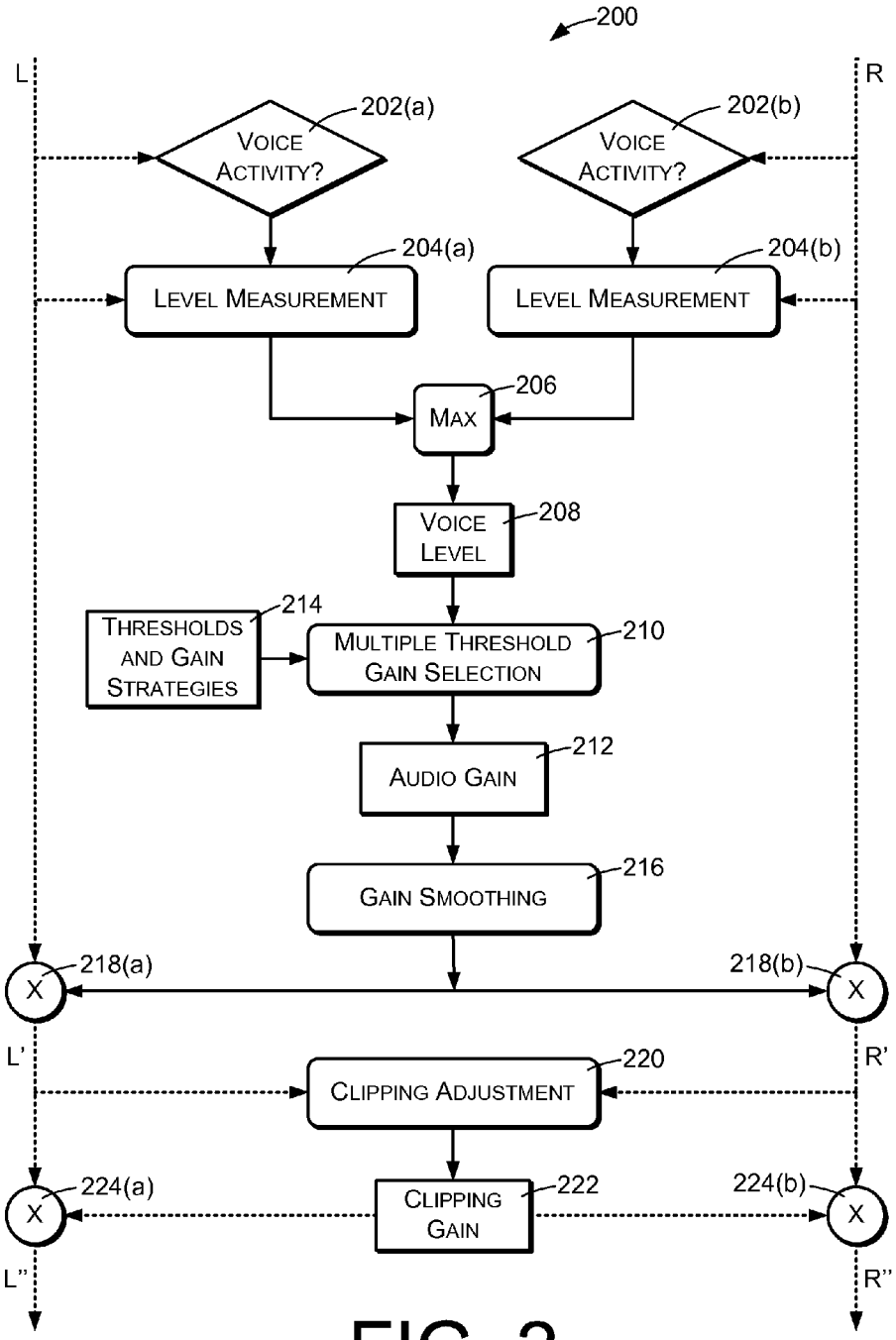
FIG. 2 is a flowchart illustrating an example method of multiple-threshold dynamic level control.

FIG. 2 shows an example process 200, illustrating how the functional elements 108 of the system logic 102 may be configured to perform DLC with respect to a received audio signal. Although the operations of FIG. 2 are described in the context of the logical components of FIG. 1, similar functionality may be implemented in many different ways.

For purposes of discussion, FIG. 2 shows stereo input and output signals. The stereo input signal comprises a left input audio signal L and a right input audio signal R. The stereo output signal comprises a left output audio signal L" and a right output audio signal R". More generally, the described techniques may be applied to any number of input and output channels or signals.

The process 200 is performed repetitively to produce a continuous output signal based on a continuous input signal. Each repetition of the process 200 may be based on an audio segment or sample, or on a collection or block of audio samples collected over a period of time.

The process 200 initially determines a voice level based on the input audio signals L and R. This comprises an action 202 of detecting voice activity or presence in the input audio signals L and R, and an action 204 of measuring the audio level of the voice activity.

The action 202 is performed independently with respect to each of the input audio signals L and R: an action 202(*a*) comprises detecting voice activity in the left input audio signal L, and an action 202(*b*) comprises detecting voice activity in the right input audio signal R.

In one embodiment, voice detection may be performed using a combination of signal envelope and noise floor estimation. In this embodiment, a ratio of an estimated input signal envelope to an estimated input noise floor is compared to a threshold to determine whether a current audio sample represents either voice or noise. The signal envelope may be determined by applying a filter having a fast attack and slow release. The noise floor may be determined by applying a filter having a slow attack and a fast release.

In another embodiment, power spectral density of the input audio signal may be analyzed to determine voice presence. For example, low-band spectral density may be compared to high-band spectral density. During periods of stationary (i.e., time-varying) noise, high and low spectral bands are likely to have roughly equal power spectral densities. During periods of voice, the low-band spectral energy is likely to be greater than the high-band spectral energy.

Although more sophisticated methods of detecting noise activity may be used, such methods have been found to be unnecessary in the implementation described herein.

The action 204 is performed independently with respect to each of the input audio signals L and R: an action 204(*a*) comprises measuring or determining an audio or voice level of the left audio signal L, and an action 204(*b*) comprises measuring or determining an audio or voice level of the right audio signal R. The voice level of an individual signal may be evaluated in several ways. As an example, a low-pass filter may be applied to absolute values of the input audio signal to determine voice level. As another example, a low-pass filter may be applied to the squared values of the input audio signal to determine the voice level. As yet another example, the average of recent values of the input audio signal may be calculated and used as a measurement of the voice level.

The level measurement of actions 204(*a*) and 204(*b*) is performed only when voice activity has been detected in the corresponding input audio signal. Otherwise, if the corresponding input audio has been determined to represent noise or other non-voice activity, the voice levels of the input audio signals are assumed to remain unchanged from previous detected voice levels.

An action 206 comprises determining a maximum voice level 208, which is the highest of the voice levels measured by the actions 204(*a*) and 204(*b*) with respect to the left and right audio channels.

An action 210 comprises selecting an audio gain 212 based on the voice level 208. The audio gain 212 is selected to produce an output audio signal of a desired amplitude or level. More specifically, the action 210 may be based on comparing the voice level 208 with a plurality of thresholds to determine which of a plurality of ranges the voice level falls within, and selecting a corresponding gain strategy. A plurality of thresholds and gain strategies 214 may be specified or predefined, and used in the gain selection 210. Further details regarding the selection of the audio gain 212 will be described in more detail below, with reference to FIG. 3.

An action 216 comprises smoothing the audio gain 212 over time. Because the audio gain 212 may change for every sample or sample block of the input signals L and R, the audio gain may vary rapidly and abruptly, which may cause undesirable and noticeable fluctuations in output levels. The gain smoothing 216 acts to dampen or slow changes to the selected gain 212 to improve the listening experience. The gain smoothing may be implemented as a first-order low-pass filter having a selected time constant that limits the rate of change of the audio gain 212 over time.

The actions 218(*a*) and 218(*b*) comprise applying the smoothed gain to both of the left and right input audio signals L and R to produce intermediate, level-adjusted left and right audio signals L' and R'. This may comprise independently scaling or multiplying each of the input audio signals L and R by the smoothed gain 212.

An action 220 comprises further adjusting or compensating the level-adjusted audio signals L' and R' to reduce or prevent clipping in peaks of the output audio signals L" and R". The clipping adjustment may be implemented by a fast acting filter, which dynamically calculates a clipping gain 222 based on observed values of the level-adjusted audio signals L' and R'. The clipping gain 222 is calculated to attenuate peaks in the level-adjusted audio signals L' and R', such as by reducing the amplitudes of any samples that are greater than 98% of the clipping level of the output signals.

The clipping adjustment may be applied on a sample-by-sample basis by a relatively fast-acting compressor. In particular, the compressor may be implemented with a time constant that is shorter than the time constant of utilized by the smoothing 216.

The clipping gain 222 is applied to the level-adjusted left and right audio signals L' and R' in actions 224(*a*) and 224(*b*), respectively. Specifically, the level-adjusted left and right audio signals L' and R' are scaled or multiplied by the clipping gain 222 to produce the left and right output signals L" and R".

Figure 3:
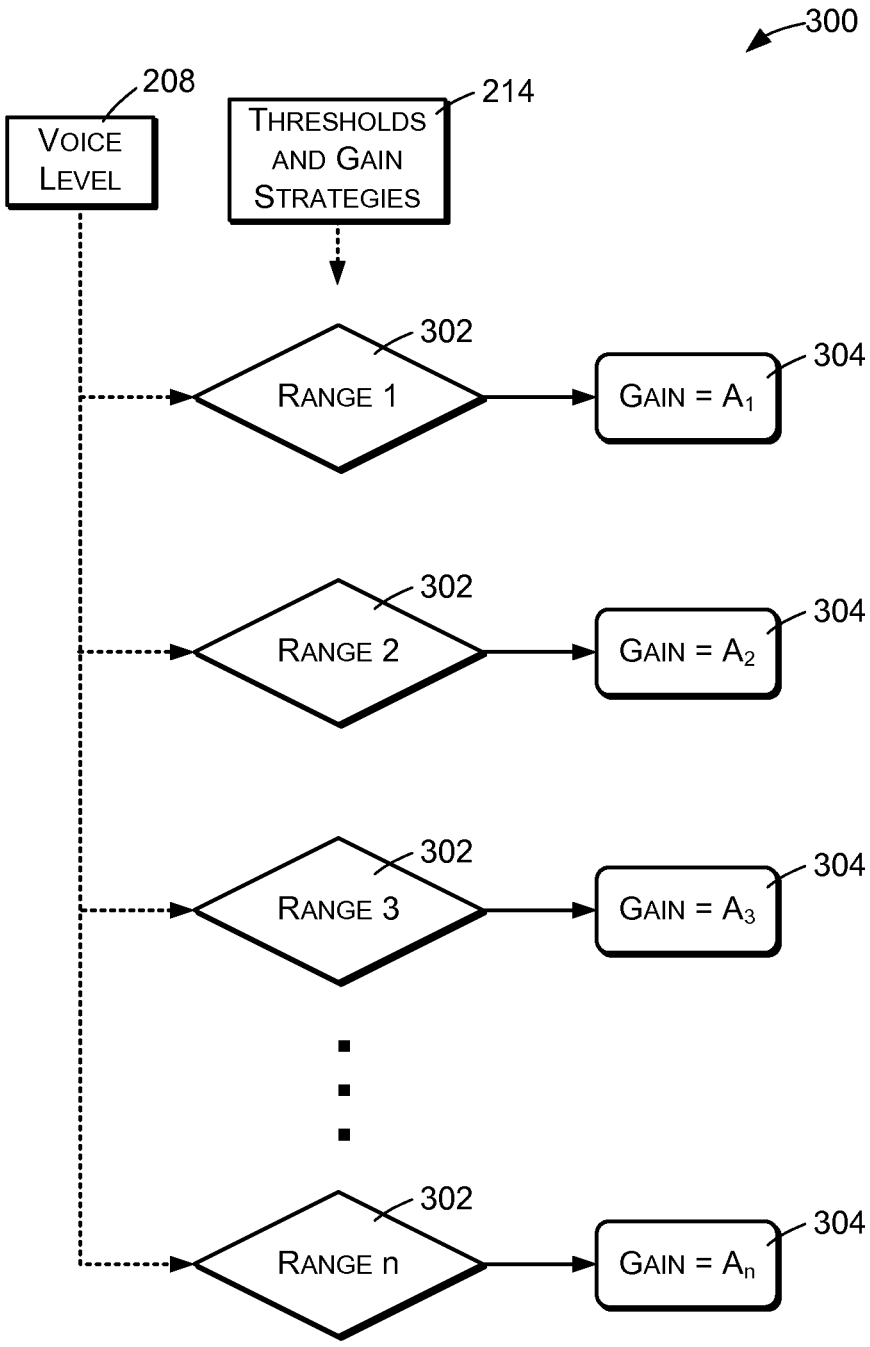
FIG. 3 is a block diagram illustrating an example of applying multiple threshold or ranges for determining gain strategies in the environment of FIGS. 1 and 2.

FIG. 3 illustrates an example method 300 that may be used to implement the gain calculation 210 of FIG. 2. Generally, selecting the audio gain 212 is based on predetermined voice level ranges that are defined by thresholds. The voice level 208 is compared with the thresholds to determine a corresponding range and gain strategy. A gain strategy may specify a constant audio gain, or may specify parameters or methods that are to be used to calculate an audio gain.

In the embodiment of FIG. 3, multiple thresholds are used to define a plurality of level ranges 302 from 1 through n. In the described embodiment, at least three ranges are defined, based on at least two thresholds. For example, an expansion range may be defined by a lower threshold, and expansion is performed when voice levels are below this threshold. A compression range may be defined by an upper threshold, with signal compression being performed when voice levels are above this threshold. A bypass range may be defined between the lower and upper thresholds, with no compression or expansion being applied when the voice level is above the lower threshold and below the upper threshold.

More generally, if the voice level 208 falls within a particular one of the ranges 302, as defined by one or more corresponding thresholds, a corresponding gain strategy 304 is applied, resulting in gains $A_1$ through $A_n$, corresponding to the ranges 1 through n respectively. The gains $A_1$ through $A_n$ may comprise constants, or may comprise values that are calculated dynamically based on the maximum voice level 208 and/or other factors. As an example, the gain may be calculated as a function of the current voice level and the threshold corresponding to the range within which the voice level falls. More specifically, the gain may be calculated by dividing the current voice level with the applicable threshold, or by dividing the applicable threshold by the current voice level—depending on whether expansion or compression is to be achieved.

The defined or calculated gains $A_1$ through $A_n$ may result in compression or expansion of the input audio signals L and R. For example, gains of less than 1.0 may be used to compress or decrease the levels of loud input audio signals L and R, while gains of greater than 1.0 may be used to expand or increase the levels of soft input audio signals L and R. A gain equal to 1.0 results in neither compression nor expansion of the audio signals. In some cases, available gains may be limited by predetermined minimum and maximum gain values.

The techniques described above allow multiple different gain adjustments and strategies to be implemented based on multiple input level thresholds or ranges.

The described noise activity detection allows the system to avoid raising audio levels during periods of low-level noise, and results in minimal changes to the signal-to-noise ratio of the audio signals. This is because gains are adjusted based only on likely periods of voice activity. Furthermore, although the described NAD techniques are computationally efficient and inexpensive, they provide good results in this environment.

Note that the gain smoothing action 216 may be implemented to limit the rate of change of the smoothed gain 218, and to prevent discontinuities in the smoothed gain 218. The clipping adjustment 222, however, is implemented to allow very quick responses to potential clipping.

The techniques described above are assumed in the given examples to be implemented in the general context of computer-executable instructions or software, such as program modules, that are stored in the memory 106 (FIG. 1) and executed by the processor 104 (FIG. 1). Generally, program modules include routines, programs, objects, components, data structures, etc., and define operating logic for performing particular tasks or implement particular abstract data types. The memory 106 may comprise computer storage media and may include volatile and nonvolatile memory. The memory 106 may include, but is not limited to, RAM, ROM, EEPROM, flash memory, or other memory technology, or any other medium which can be used to store media items or applications and data which can be accessed by the system logic 102. Software may be stored and distributed in various ways and using different means, and the particular software storage and execution configurations described above may be varied in many different ways. Thus, software implementing the techniques described above may be distributed on various types of computer-readable media, not limited to the forms of memory that are specifically described.

Although the discussion above sets forth an example implementation of the described techniques, other architectures may be used to implement the described functionality, and are intended to be within the scope of this disclosure. Furthermore, although specific distributions of responsibilities are defined above for purposes of discussion, the various functions and responsibilities might be distributed and divided in different ways, depending on circumstances.

Furthermore, although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A computing device, comprising:

a processor;

one or more microphones configured to generate an input audio signal;

one or more speakers; and memory, accessible by the processor and storing instructions that are executable by the processor to perform acts in multiple repetitions, the acts of each repetition comprising:

detecting voice presence in the input audio signal;

determining a voice level associated with the voice presence in the input audio signal;

comparing the voice level to at least one of a plurality of threshold amplitudes, each threshold amplitude of the plurality of threshold amplitudes corresponding to one of multiple level ranges;

identifying one of the multiple level ranges to which the voice level corresponds based at least in part on the comparing;

selecting an audio gain based at least in part on the identified one of the multiple level ranges;

smoothing the selected audio gain over time;

scaling the input audio signal by the selected and smoothed audio gain to produce an intermediate audio signal; and attenuating the intermediate audio signal to reduce clipping, wherein the attenuating produces an output audio signal for output by the one or more speakers.

2. The computing device of claim 1, wherein detecting the voice presence comprises performing noise activity detection (NAD) with respect to the input audio signal.

3. The computing device of claim 1, wherein detecting the voice presence comprises estimating a signal envelope and a noise floor of the input audio signal.

4. The computing device of claim 1, wherein:

the smoothing is performed by a first order low-pass filter having a first time constant that limits the rate of change of the selected and smoothed audio gain over time; and the attenuating is applied to peaks of the intermediate audio signal with a compressor having a second time constant that is shorter than the first time constant.

5. The computing device of claim 1 wherein:

the input audio signal comprises a left input audio signal and a right input audio signal corresponding to left and right stereo channels, respectively; and determining the voice level comprises determining a maximum of: (i) a voice level of the left input audio signal, and (ii) a voice level of the right input audio signal.

6. A method of dynamically controlling an audio level, comprising:

specifying a plurality of thresholds to define multiple level ranges and corresponding gain strategies;

detecting voice presence in one or more audio signals, the one or more audio signals including the voice presence and other noise;

determining a voice level associated with the voice presence in the one or more audio signals;

comparing the voice level to the plurality of thresholds to identify one of the multiple level ranges to which the determined voice level corresponds; and selecting an audio gain based at least in part on the identified one of the multiple level ranges.

7. The method of claim 6, further comprising applying the selected audio gain to the one or more audio signals to create one or more output audio signals.

8. The method of claim 6, further comprising smoothing the selected audio gain over time.

9. The method of claim 6, further comprising:

applying the selected audio gain to the one or more audio signals to create one or more intermediate audio signals; and attenuating peaks of the one or more intermediate audio signals to reduce clipping.

10. The method of claim 6, further comprising:

smoothing the selected audio gain over time using a first time constant;

applying the selected and smoothed audio gain to produce one or more intermediate audio signals; and attenuating peaks of the one or more intermediate audio signals to reduce clipping, wherein the attenuating is performed using a second time constant that is shorter than the first time constant.

11. The method of claim 6, wherein detecting the voice presence comprises performing noise activity detection (NAD) with respect to the one or more audio signals.

12. The method of claim 6, wherein detecting the voice presence comprises estimating a signal envelope and a noise floor of the one or more audio signals.

13. One or more non-transitory computer-readable media storing computer-executable instructions that, when executed by one or more processors, cause the one or more processors to perform acts comprising:

detecting voice presence in one or more audio signals, the one or more audio signals including the voice presence and other noise;

determining a voice level associated with the voice presence in the one or more audio signals;

specifying a plurality of thresholds to define multiple level ranges and corresponding gain strategies;

comparing the voice level to the plurality of thresholds to identify one of multiple level ranges to which the voice level corresponds;

selecting an audio gain based at least in part on the identified one of the multiple level ranges; and applying the selected audio gain to the one or more audio signals.

14. The one or more non-transitory computer-readable media of claim 13, further comprising smoothing the selected audio gain over time.

15. The one or more non-transitory computer-readable media of claim 13, wherein applying the selected audio gain produces one or more intermediate audio signals, the acts further comprising attenuating peaks of the one or more intermediate audio signals to reduce clipping.

16. The one or more non-transitory computer-readable media of claim 13, wherein applying the selected audio gain produces one or more intermediate audio signals, the acts further comprising:

smoothing the selected audio gain over time using a first time constant; and attenuating peaks of the one or more intermediate audio signals to reduce clipping, wherein the attenuating is performed using a second time constant that is shorter than the first time constant.

17. The one or more non-transitory computer-readable media of claim 13, wherein detecting the voice presence comprises performing noise activity detection (NAD) with respect to the one or more audio signals.

18. The one or more non-transitory computer readable media of claim 13, wherein detecting the voice presence comprises estimating a signal envelope and a noise floor of the one or more audio signals.

19. The one or more non-transitory computer-readable media of claim 13, wherein the one or more audio signals comprise left and right audio signals corresponding to left and right stereo channels, respectively.

20. The one or more non-transitory computer-readable media of claim 13, wherein the other noise includes stationary noise.

* * * * *